US010141177B2

(12) United States Patent
Muntean et al.

(10) Patent No.: US 10,141,177 B2
(45) Date of Patent: Nov. 27, 2018

(54) MASS SPECTROMETER USING GASTIGHT RADIO FREQUENCY ION GUIDE

(71) Applicant: Bruker Daltonics, Inc., Billerica, MA (US)

(72) Inventors: Felician Muntean, Andover, MA (US); Stephen Zanon, Campbell, CA (US)

( * ) Notice: Subject to any disclaimer, the term of this patent is extended or adjusted under 35 U.S.C. 154(b) by 0 days.

(21) Appl. No.: 15/434,233

(22) Filed: Feb. 16, 2017

(65) Prior Publication Data

US 2018/0233346 A1 Aug. 16, 2018

(51) Int. Cl.

| | |
|---|---|
| ***H01J 49/24*** | (2006.01) |
| ***H01J 49/42*** | (2006.01) |
| ***H01J 49/06*** | (2006.01) |
| ***H01J 49/00*** | (2006.01) |

(52) U.S. Cl.

CPC ..... *H01J 49/4215* (2013.01); *H01J 49/0045* (2013.01); *H01J 49/062* (2013.01); *H01J 49/24* (2013.01)

(58) Field of Classification Search

CPC ..... H01J 49/0045; H01J 49/06; H01J 49/062; H01J 49/063; H01J 49/065; H01J 49/24; H01J 49/4215

See application file for complete search history.

(56) References Cited

U.S. PATENT DOCUMENTS

| | | | | |
|---|---|---|---|---|
| 6,465,792 | B1 | 10/2002 | Baptist | |
| 6,576,897 | B1 | 6/2003 | Steiner et al. | |
| 7,935,924 | B2 | 5/2011 | Cheung et al. | |
| 8,552,366 | B2 | 10/2013 | Hoyes | |
| 9,524,857 | B2 * | 12/2016 | Kovtoun | H01J 49/062 |
| 2004/0026614 | A1 * | 2/2004 | Bateman | H01J 49/065 250/281 |
| 2004/0251411 | A1 * | 12/2004 | Bateman | H01J 49/005 250/293 |

(Continued)

FOREIGN PATENT DOCUMENTS

| | | | |
|---|---|---|---|
| EP | 2804201 | A2 | 11/2014 |
| GB | 2490792 | A | 11/2012 |
| GB | 2492893 | A | 1/2013 |

OTHER PUBLICATIONS

Hanley et al., "Collision-induced dissociation of aluminum cluster ions; Fragmentation patterns, bond energies, and structurs for Al2+—Al7+", The Journal of Chemical Physics 87(1), 260 (Jul. 1987).

*Primary Examiner* — David E Smith

(74) *Attorney, Agent, or Firm* — Benoit & Côté Inc.

(57) ABSTRACT

The disclosure relates to a mass spectrometer, comprising (a) a vacuum recipient containing ion handling elements of the mass spectrometer, the vacuum recipient having a plurality of walls which define a gastight volume and comprise at least one of an entrance and exit, wherein different portions of an ion path pass at least one of the entrance and exit and run through the gastight volume; and (b) a gastight radio frequency ion guide having an ion passage along an axis and being mounted gastight to at least one of the entrance and exit as to continue the ion path in its ion passage outside the gastight volume. Embodiments of the disclosure facilitate, in particular, reducing pumping volumes in the mass spectrometer and corresponding pumping requirements as well as lowering the size and weight of such an assembly.

20 Claims, 3 Drawing Sheets

(56) References Cited

U.S. PATENT DOCUMENTS

| | | | | |
|---|---|---|---|---|
| 2014/0339414 | A1* | 11/2014 | Loboda | H01J 49/066 250/281 |
| 2016/0035556 | A1* | 2/2016 | Berkout | H01J 49/066 250/288 |

* cited by examiner

MASS SPECTROMETER USING GASTIGHT RADIO FREQUENCY ION GUIDE

BACKGROUND OF THE INVENTION

Field of the Invention

This invention relates to compact mass spectrometers, such as compact triple quadrupole mass spectrometers or single quadrupole mass spectrometers and has the overall aim to lower size, weight, and pumping requirements of these assemblies.

Description of the Related Art

The related art will be exemplified below referring to one particular aspect thereof. This is however not to be taken restrictively. Beneficial advancements and modifications of prior art elements known to one of skill in the art may also be applicable beyond the comparatively narrow scope of the introduction below and will readily suggest themselves to skilled practitioners in the field having the benefit of the subsequent disclosure.

A collision cell in a mass spectrometer usually consists of a radio frequency (multipole) ion guide filled with collision gas and is positioned in the ion-optical path between two mass analyzers; a first mass analyzer that selects precursor ions and a second mass analyzer that selects or analyzes product ions created in the collision cell, while rejecting the unselected ions in each case. Examples would be the well-known triple quadrupole mass spectrometers (triple quads), quadrupole-time of flight mass spectrometers (Q-TOF MS) or quadrupole-Fourier transform mass spectrometers (Qq-FT MS), for example.

Most mass analyzers require operation in a virtually collision-free vacuum environment ($<10^{-3}$ pascal) whereas a collision cell is operated at elevated gas pressure (0.1-2 pascal) to allow a significant number of ion-gas collisions along its path. As the collision cell needs to be placed between the two mass analyzers, conflicting vacuum requirements result. In the related art, these conflicting vacuum requirements lead to designs that pay the cost of (i) larger-than-necessary vacuum recipients (or vacuum manifolds) such that at least one mass analyzer and the collision cell can be accommodated in the same volume, and also (ii) larger-than-necessary and wasteful pumping systems, which need to pump not only the volume of the mass analyzer region but also the volume around the collision cell enclosure, although the latter does not require the same vacuum level.

Another challenge with mass spectrometer construction today stems not only from the fact that the ion source region usually operates at a particular pressure and the analyzer region, in order to fulfil the no-collision requirement, operates at a comparatively lower pressure but that manufacturers also typically try to equip their instruments with a single turbo-molecular pump. In such case, the interstages of the turbo-molecular pump is/are used to evacuate the ion source region/s and an upper stage of the turbo-molecular pump is used to evacuate the analyzer region. Prior art mass spectrometer designs are mostly laid out in one plane, which leads to inefficient pumping of either the ion source region or the mass analyzer region, because one of them is farther away from the pump rotor blades.

Furthermore, several types of mass spectrometers, such as triple quadrupoles, are transcending the scientific/academia markets toward the routine lab/consumer markets where a smaller size and a lower cost are key factors to consider for commercial success.

Prior art designs not only struggle with oversized system structures and oversize pumping systems to pump unnecessary built-in volumes but are also faced with inefficient ion transmission between different portions of the mass spectrometer due to ion losses brought about by restrictive apertures that are provided to limit the gas outflow from one pumping region of the mass spectrometer to the other.

So there is a need to improve the efficiency of mass spectrometer designs by bringing both the ion source and mass spectrometric analyzers close to the pump rotor blades and reduce the mass spectrometer volume to be pumped. Also there is a need to build smaller footprint size and lower cost mass spectrometer systems by improving the efficiency of vacuum systems without compromising ion transmission or mass spectrometric sensitivity.

U.S. Pat. No. 8,525,106 B2 describes a triple quadrupole system with a single vacuum recipient which contains two mass filters as well as one ion guide Q0 and a collision cell Q2. The two volumes around the ion guide and the volume around the collision cell either alone or in combination are not strictly necessary but rather unnecessarily burden the pumping system.

In view of the foregoing, there is still a need for mass spectrometers and associated components which represent an improvement over that which has been known in the state of the art. Further objectives and beneficial effects of the present invention will readily suggest themselves to those of skill in the art upon reading the following disclosure.

SUMMARY OF THE INVENTION

The present invention provides for a mass spectrometer, comprising (a) a vacuum recipient containing ion handling elements, such as mass filters or other ion-optical elements, the vacuum recipient having a plurality of walls which define a substantially gastight volume and comprise at least one of an entrance and exit, which may be manifested as ports in the plurality of walls, wherein different portions of an ion path pass at least one of the entrance and exit and run through the substantially gastight volume; and (b) a substantially gastight (and possibly gas-supplied) radio frequency ion guide, such as a tubular multipole ion guide, having an ion passage along an axis and being mounted substantially gastight to at least one of the entrance and exit as to continue the ion path in its ion passage outside the substantially gastight volume, such as to be operative in a standard lab environment at standard atmospheric pressures on the order of $10^5$ pascal.

The inventors have found that pumping requirements for volumes in a mass spectrometer to be pumped can be advantageously lowered when the pumping volumes associated with different ion handling elements, such as ion source region and collisional-cooling ion guide or collision cell on the one hand, which operate at higher pressures, and mass analyzers or filters on the other hand, which need a high vacuum environment, are separated from one another and reduced to a practicable minimum. This course of action potentially improves system performance due to the more efficient pumping of the different regions in the mass spectrometer. Additionally or alternatively, this course of action creates cost savings because of lower material consumption and reduced manufacturing time since the vacuum enclosures can be made smaller and also because of the option to use smaller and thus lower-cost pumping systems. Other improvements over the prior art include the possibility to connect electrical components and multipolar drivers from atmosphere to vacuum.

This invention improves the aspects of optimizing cost, weight and turbo pump size due to the close proximity of the turbo pump rotor blades to the critical ion path and analyzer region. This unprecedented combination of design features allows selecting a smaller size turbo pump for an equivalent gas load versus other applications in the art of triple quadrupoles. In other words, it can be said that the efficient placement of ion path to turbo pump rotor blades minimizes the losses of the available top speed of the turbo pump to pumping regions, maximizes conductance to analyzer region, and, due to these optimizations, the weight savings/cost is optimized to a minimum, while the turbo pump is able to perform in a reliable manner and well within the critical functional temperature requirements of the turbo molecular pump bearing and motor specifications.

The compact optimization aspect improvements carry also ease of access and reliability improvements. In one implementation of these improvements, the ion source region can be operated at a higher than room temperature setting, say 150° C. and above, the analyzer region can be operated at stability temperatures for the quadrupoles at about 40° C., and still the turbo molecular pump can be running well within bearing and motor limitation specifications. In another aspect, the service ability allows the turbo pump itself to become part of the ion analyzer housing, where the service aspect would be just to exchange the turbo pump bearing.

In various embodiments, the ion passage can have substantially polygonal cross section, such as a substantially rectangular or square cross section. It is possible to configure the ion passage as either straight or curved. In the curved case, an angle of curvature may range from substantially 45° to 180°. Curved axis ion passages facilitate in particular more complicated trajectories of ion paths than just straight ones, laid out in one plane, and thus render more flexibility in the spatial lay-out of the mass spectrometer assembly. Furthermore, curved gastight radio frequency ion guides provide for lower gas conductance so that flow-limiting orifices or apertures at the front and back ends of the RF ion guide can be significantly increased in size or even completely dispensed with, which helps the ion transmission properties through the RF ion guide.

In various embodiments, at least one of a length and a transverse dimension of the ion passage can be chosen such as to facilitate a functioning of the (possibly gas-supplied) radio frequency ion guide as restrictor tube and to thereby reduce stray gas admission into the gastight volume of the vacuum recipient through the ion passage. By way of example, longitudinal (axial) and transverse (radial) dimensions of the ion passage may be chosen between about 80 and 200 millimeters and 5 and 9 millimeters diameter, respectively. In particular embodiments, the restrictor tube effect can produce an improvement in the high vacuum pressure up to 40% compared to a lens restriction. The restrictor tube design in combination with a rectangular slot access port to the interstage can improve vacuum pressure conditions greater than 30% compared with a vacuum industry standard ISO 40 or KF 40 flange connection to the ion guides.

In various embodiments, a turbo-molecular pump can be provided which is docked to the vacuum recipient through a pumping port at one of the plurality of walls. A turbo-molecular pump may have a plurality of rotor blade stages. Usually the stage generating the lowest vacuum pressure will be used to evacuate the vacuum recipient whereas subsequent stages could be used to pump other compartments, such as an ion source region, for instance, being associated with the mass spectrometer but not part of the vacuum recipient and its volume, which need not be pumped to high vacuum.

In various embodiments, the ion handling elements may comprise two mass filters in a triple quadrupole arrangement being located in the substantially gastight volume (in parallel), and the radio frequency ion guide can be a gas-supplied ion collision cell being positioned along the ion path in between the two mass filters; outside the substantially gastight volume in an ambient environment, for example. The mass filters require comparatively high vacuum for optimum operation whereas a gas-supplied radio frequency ion guide might not be subject to the same vacuum requirement. Thus, it turns out to benefit the whole mass spectrometer assembly when such ion guide is removed from the vacuum recipient and merely docked thereto gastight such that ions following the ion path can traverse through corresponding ports at the plurality of walls of the vacuum recipient out of and back into the gastight volume again.

In various alternative embodiments, the ion handling elements may comprise a mass filter being located in the substantially gastight volume, and further an ion source located outside the substantially gastight volume can be foreseen, wherein the radio frequency ion guide is positioned in between the mass filter and the ion source to operate as collisional-cooling ion guide which transmits a collimated beam of ions from the ion source to the mass filter. Such design is particularly suitable for single quadrupole mass spectrometers but likewise also for triple quadrupole mass spectrometers.

In various embodiments, the substantially gastight radio frequency ion guide may have a plurality of layers bonded substantially gastight to one another, such as by adhesive (i.e. glued), at least two layers of the plurality of layers comprising substantially central cut-outs to form the ion passage, wherein at least two layers of the plurality of layers adjacent to the ion passage encompass at least one conductive feature facing the axis and being electrically connected to function as radio frequency electrodes. The radio frequency ion guide may have a multipole configuration, such as a quadrupole, hexapole, octopole configuration or the like.

The plurality of layers may comprise plates of insulating material, such as printed circuit boards (PCBs), and the electrical connection can be brought about by electrical circuits or conductive tracks on or in the plates of insulating material, e.g. said printed circuit boards. The edges of the plates of insulating material that come to lie adjacent the ion passage can be made conductive, for instance, by metallization and electrically contacted so as to form radio frequency electrodes which generate the RF confining fields for the ions. As an alternative to PCBs, ceramic plates could also be suitable as plates of insulating material.

In various embodiments, the plurality of layers can comprise two layers of non-conductive material, wherein the substantially central cut-outs may comprise substantially triangular recesses in the two layers opposing one another. The at least one conductive feature can comprise slanted metallized surfaces at side walls of the substantially triangular recesses. It is possible to foresee additional cut-outs between the conductive features to provide for safe electrical decoupling of the radio frequency electrodes in such a design.

In various embodiments, the plurality of layers may comprise a top layer, a bottom layer and a group of intermediate layers. The group of intermediate layers can comprise plates of conductive material, such as steel plates, which may be used as the radio frequency electrodes for the ion confinement field. The top and bottom layers can comprise plates of insulating material, for example.

Preferably, the at least one conductive feature comprises beveled edges at the plates of conductive material. It is possible to arrange for the plates of conductive material to be spaced apart from one another by at least one intermediate plate of insulating material; in particular in order to reliably avoid electrical arcing between the different electrodes.

Additional or alternative embodiments comprise the plates of conductive material having recessed features so as to neatly accommodate parts of the at least one intermediate plate of insulating material, which provides for a particularly robust structure.

BRIEF DESCRIPTION OF THE DRAWINGS

The invention can be better understood by referring to the following figures. The components in the figures are not necessarily to scale, emphasis instead being placed upon illustrating the principles of the invention (often schematically). In the figures, like reference numerals designate corresponding parts throughout the different views.

DETAILED DESCRIPTION

While the invention has been shown and described with reference to a number of different embodiments thereof, it will be recognized by those of skill in the art that various changes in form and detail may be made herein without departing from the scope of the invention as defined by the appended claims.

Figure 1A:
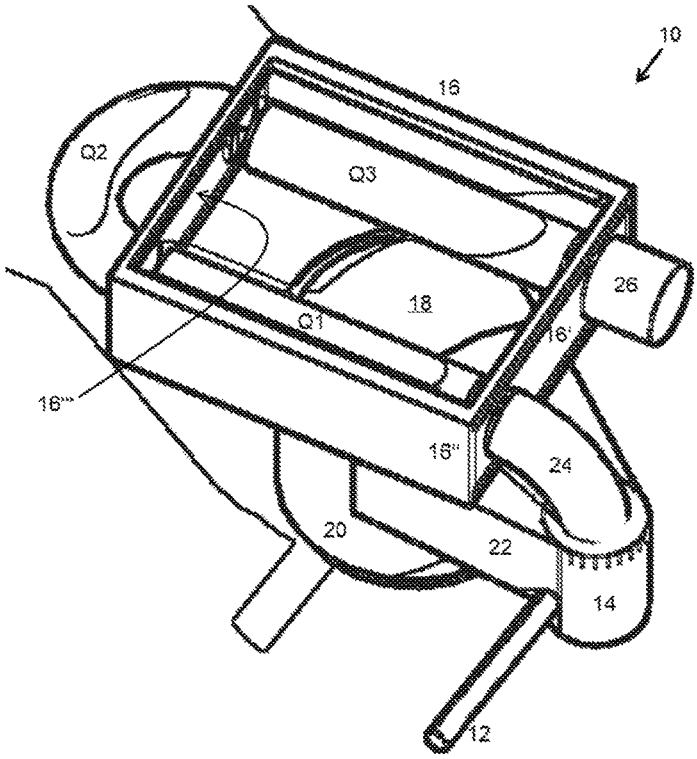
FIG. 1A is a schematic perspective view of a first embodiment of a mass spectrometer built and assembled according to principles of the present disclosure.
Figure 1B:
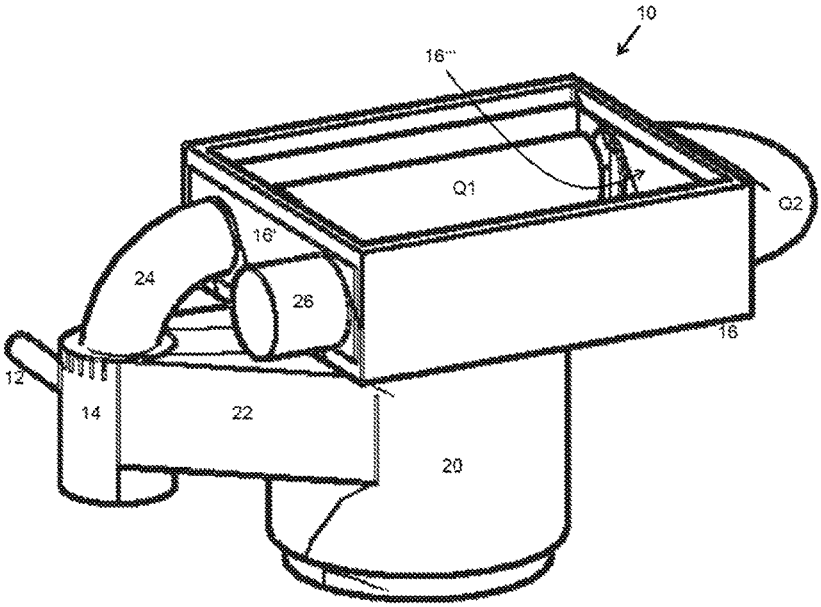
FIG. 1B is a different schematic perspective view of the first embodiment of the mass spectrometer shown in FIG. 1A.

FIGS. 1A and 1B illustrate schematically a triple quadrupole mass spectrometer 10 constructed and assembled according to principles of this disclosure. The concept and operation of a triple quadrupole mass spectrometer 10 are well known to one of skill in the art and therefore need no further elaboration here.

In the example shown, a sample to be analyzed mass spectrometrically may be supplied from a preceding separation device, such as a gas chromatograph (GC) or liquid chromatograph (LC) (not illustrated), the associated transfer line of which is shown at 12. The fluid (gaseous or liquid) sample containing the analyte molecules of interest enters the ion source region 14 in a sequence of substance peaks separated and ordered by their time of elution from the chromatographic column (not depicted). The ion source region 14 may operate with an ionization mechanism suitable for ionizing gaseous samples, if the eluent is from a GC, such as (i) electron ionization (EI) where the gaseous neutral analyte molecules are bombarded with a beam of high-energetic electrons, such as at 70 electron volts, (ii) chemical ionization (CI) where the gaseous neutral analyte molecules are intermingled with reagent ions from a reagent ion source, such as methane, so as to bring about ionization by charge transfer such as protonation, or (iii) a glow discharge where ions are formed from gaseous atoms or molecules by applying a potential difference between two electrodes immersed in a low-pressure gas environment. If the eluent stems from an LC, suitable ionization mechanisms would include, among others, electrospray ionization (ESI), for instance.

Once ionization has been accomplished, the charged particles or analyte ions so formed can be extracted from the ion source region 14 and passed on to a first mass filter Q1 which is located within a substantially gastight vacuum recipient 16 being closed on all sides by walls 16', 16", 16''' etc. (though shown with the upper side open in FIGS. 1A and 1B for the sake of illustration). In this example, the recipient 16 has basically rectangular "brick" shape with two long dimensions (length and breadth) and one comparatively short dimension (height or thickness). The short dimension facilitates referring to the lateral periphery of the vacuum recipient 16 as narrow sides. A pumping port opening 18 is located on the lower broad side of the recipient 16 which can be seen through the missing upper lid. A turbo-molecular pump 20 is connected to the pumping port opening 18 in order to extract residual gas there-through during operation and establish a particularly desired pressure level within the confines of the recipient 16, such as pressures equal to or lower than $10^{-3}$ pascal suited to operate a mass filter, such as Q1.

In the example arrangement shown in FIGS. 1A and 1B, the ion source region 14 is evacuated to a pressure level moderately higher than that maintained within the confines of the recipient 16 using the very same turbo-molecular pump 20 by virtue of its being fluidly connected through substantially gastight housing 22 to an interstage of the pump rotors situated below the pumping port 18 at the recipient 16. The principle of interstage pumping of different stages in a mass spectrometer has been described, by way of example, in U.S. Pat. No. 8,716,658 B2 to I. D. Stones and will be familiar to a practitioner in the field.

Transferring the ions from the ion source region 14 to the first mass filter Q1 is achieved using a substantially gastight radio frequency multipole ion guide 24 such as a quadrupole ion guide that is bent by substantially 90-degrees in the example shown. The ion guide 24 may be implemented using a multi-layered design as will become apparent from the description further below.

Generally, however, the 90-degrees ion guide 24 can be constructed as an assembly of ion guide rods tightly enclosed in a vacuum sealed tube with minimal volume inside the tube beyond the volume between the ion guide rods ("tubular multipole ion guide"). This ion guide tube can have vacuum feedthroughs at both ends, which may include electrical connections, such that it can be a distinct component of a mass spectrometer and does not have to be mounted inside another vacuum enclosure such as the vacuum recipient 16. Rather, it can be placed and operated in a lab environment which may be at standard atmospheric pressures on the order of $10^5$ pascal. Such tubular construction renders minimum vacuum conductance while at the same time providing for maximum ion guide opening at the front and back ends without the need to use restrictive apertures/orifices which could limit conductance and negatively affect ion transmission efficiency. The 90-degrees ion guide 24 may have a longitudinal extension of about 50 to 100 millimeters, for instance.

A key advantage of a curved ion guide, such as shown at 24, is that it allows a mass spectrometer design where the ion source 14 and the analyzer regions of the mass spectrometer 10 can be positioned in different pumping regions but in the immediate proximity to the turbo-molecular pump blades in their own pumping region (at different height levels).

The 90-degrees ion guide 24 is preferably provided with a pure and inert gas such as molecular nitrogen, helium or neon, or alternatively with a just semi-inert gas such as ambient air through a gas supply structure not visible in FIGS. 1A and 1B at an intermediate pressure level of about between 0.1 and 1 pascal in order that the ions can be formed into a well collimated beam upon being passed on to the first mass filter Q1. Using ambient air which is just aspirated from outside the vacuum enclosures simplifies the gas supply arrangements significantly. Since the ion source region 14 is located outside, and the first mass filter Q1, on the other hand, inside the recipient 16, the 90-degrees ion guide 24 represents the substantially gastight connecting link between the two. The ion guide 24 docks with its front end onto a port at the ion source region 14 in order to receive the ions therefrom and with its back end onto a port at a narrow side wall 16' of the recipient 16, both in a substantially gastight manner as to not increase the gas load on the enclosures due to uncontrolled leakage of ambient air. The substantially gastight docking can be achieved, for instance, by mechanical screwing or clamp bolting while using at the same time intermediate layers of flexible, elastic sealing material, such as rubber O-rings. The first mass filter Q1 is positioned in the recipient 16 with its front end in spatially close relation to the port at the narrow side wall 16' and thereby ready to receive the collimated ion beam from the 90-degrees ion guide 24 there-through.

The gastight configuration and curved shape of the 90-degrees ion guide 24 lead to favorably low gas conductance properties, without having to employ geometry-restricting orifices at its front and back ends, and thereby facilitate low stray gas admission from the ion source region 14, which usually operates under lesser vacuum requirements, into the gastight volume of the recipient 16, which has to be kept well evacuated.

The lengths of the recipient 16 and the first mass filter Q1 are chosen such that the back end of the first mass filter Q1 comes to lie opposite another port in a narrow side wall 16''' that is located opposite the narrow side wall 16' facing the 90-degrees ion guide 24. A second radio frequency multipole ion guide such as a quadrupole collision cell Q2 having a substantially 180-degrees configuration is docked to this second port in a substantially gastight manner to thereby receive those ions from the initial ion beam that have not been filtered out by the first mass filter Q1. The substantially gastight docking may also in this case be accomplished by seal-bolting the front and back ends of the 180-degrees collision cell Q2 against the narrow side wall 16'''. The 180-degrees collision cell Q2 may be implemented using a layered design as will become apparent from the description further below.

Generally, however, and as set out before, the 180-degrees collision cell Q2 may be constructed as an assembly of ion guide rods tightly enclosed in a vacuum sealed tube with minimal volume inside the tube beyond the volume between the ion guide rods. This collision cell can have vacuum feedthroughs at both ends and may comprise electrical connection feedthroughs, such that it can be a distinct component of a mass spectrometer and does not have to be mounted inside another vacuum enclosure such as the vacuum recipient 16. Such closed tubular construction renders minimum vacuum conductance while at the same time providing for maximum ion guide opening at the front and back ends without the need to use restrictive apertures/orifices which might limit conductance and negatively affect ion transmission efficiency. The 180-degrees collision cell Q2 can have a longitudinal extension of about 90 to 200 millimeters, for instance.

For a compact triple quadrupole mass spectrometer 10, this collision cell Q2 can be 180-degrees curved, such that it connects to the same narrow side wall 16''' of the vacuum recipient where the Q1 and Q3 mass filters are mounted with their back and front ends, respectively. This arrangement allows a smaller volume for the vacuum recipient 16 and thusly renders more efficient pumping, or in other words, better performance at the same pump size. Another benefit is that this design also reduces the size/weight and complexity/cost of the vacuum recipient 16 of the mass spectrometer system 10 thusly configured.

The 180-degrees collision cell Q2 can be made using printed circuit boards with electronic components and conductive traces built-in. The collision cell Q2 may have its own electrical feedthroughs to connect with a dedicated RF and DC power supply or it can be fed with electrical signals from the vacuum recipient 16 through its end feedthroughs. Further, the 180-degrees collision cell Q2 is made substantially gastight and can have a system of gas channels as well as seals and may be fed with collision gas, such as argon or molecular nitrogen or in some instances even ambient air at about 0.2 pascal, by a gas feedthrough within its insulating body or by a gas pipe from the vacuum recipient 16 to which it is mounted. In so doing, precursor ions selected in the preceding first mass filter Q1 enter the 180-degrees collision cell Q2 preferably at elevated kinetic energy of about, for example, 20-50 electron volts and become fragmented due to collision-induced dissociation (CID) while passing the substantially gastight 180-degrees arch outside the confines of the vacuum recipient 16. The back end of the 180-degrees collision cell Q2 docks again to another third port at the same narrow side wall 16''' of the recipient 16 to guide the filtered ions and fragments generated therefrom back into the confines of the recipient 16.

The gastight configuration and curved shape of the 180-degrees collision cell Q2, into which the collision gas is usually supplied at some point midway along the axis between the front and back ends, lead to favorably low gas conductance properties, without having to employ geometry-restricting orifices at its front and back ends, and thereby facilitate low stray gas admission from the point of collision gas supply (not shown) into the gastight volume of the recipient 16, which has to be kept well evacuated as has been elaborated before.

A second mass filter Q3, the dimensions and general configuration of which can be basically the same as those of the first mass filter Q1, is located in the recipient 16 with its front end opposite the third port at the narrow side wall 16''' in order that the selected precursor ions and associated fragments are received and passed on to an ion detector mounted substantially gastight and laterally offset in a can 26 just outside the recipient 16 at the narrow side wall 16' facing the 90-degrees ion guide 24 in this example. Selected precursor ions and their fragments exiting the 180-degrees collision cell Q2 pass through the second mass filter Q3, which is aligned basically parallel to the first mass filter Q1, to be filtered again and the corresponding ionic output, such as selected fragment ions, leaves the confines of the recipient 16 through a fourth port to be measured by the detector.

From the above description, it is evident that the ion path in this exemplary triple quadrupole mass spectrometer 10 comprises several portions. It starts at the ion source region 14 located outside the vacuum recipient 16 and runs via the 90-degrees ion guide 24, likewise located outside the recipient 16, through an entrance at the narrow side wall 16' into the confines of the recipient 16. Within the recipient 16 it continues in the first mass filter Q1 straight up to the opposite narrow side wall 16''' and through an exit therein to follow the 180-degrees arch in the collision cell Q2 located outside the recipient 16. Then, the ion path re-enters the vacuum recipient 16 through another entrance at the narrow side wall 16''' to follow a straight portion within the second mass filter Q3 up to the ion detector which is reached in this case through another port in the narrow side wall 16'. To this port the substantially gastight can 26 is attached in which the detector is mounted.

The following part of the disclosure will now present particularly favorable embodiments of how to construct a substantially gastight (and possibly gas-supplied) radio frequency multipole ion guide fit to be used as the 90-degrees ion guide and/or the 180-degrees collision cell depicted in the above example.

It will be acknowledged by practitioners in the field that one of the first attempts to use an arrangement of stacked plates as ion guide in the field of mass spectrometry, where the stacked plates are oriented parallel to the axis of ion propagation instead of perpendicular thereto, was reported by Luke Hanley et al. (The Journal of Chemical Physics 87, 260 (1987); doi: 10.1063/1.453623); though this apparatus called "cooling trap" was devised with an open design which precluded a hermetically sealed, gastight operation.

Such new stacked plate concept, however, was seized and expanded on by U.S. Pat. No. 6,891,157 B2 to Bateman et al. who suggested an ion guide comprised of a stack of electrodes alternately mounted on or deposited on insulators in a "less leaky" configuration suitable to be used as a collision or reaction cell. However, no details are given in the '157 patent about how the alternately stacked electrodes and insulators are held together.

U.S. Pat. No. 6,576,897 B1 to Steiner et al. presented a kind of stacked plate approach for an ion collision cell in a triple quadrupole mass spectrometer, which approach encompasses four conductive poles (quadrupole arrangement) being sandwiched between two insulating support plates and stabilized by spacer rings. The ion passage formed between the poles is sealed gastight against the evacuated environment by silicone gaskets and seals clamped in between the support plates and poles. The whole assembly is held together by mounting screws and can be disassembled; see FIG. 9 of the '897 patent, for example. The illustrations of the Steiner et al. disclosure depict vacuum recipients/manifolds in the confines of which substantially all of the mass spectrometric ion handling elements such as mass filters and collision cells are mounted. In so doing, a comparatively large dead volume is created within the recipient that unnecessarily increases the requirements on a vacuum pump operating to establish and maintain low pressure levels in the vacuum recipient.

Figure 2:
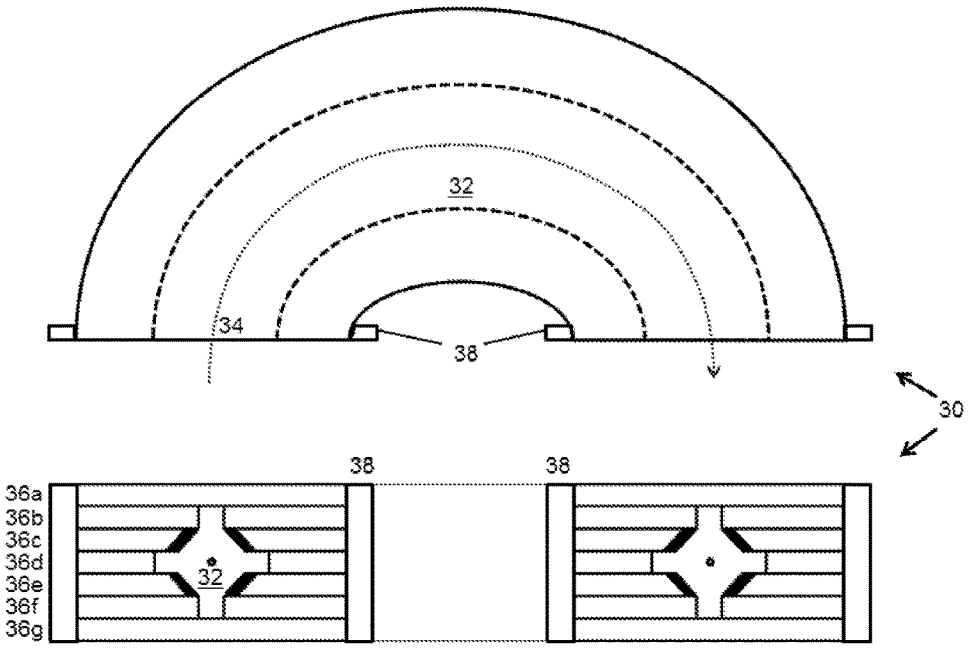
FIG. 2 is a schematic view of a first embodiment of a layered substantially gastight radio frequency (multipole) ion guide, which may be gas-supplied.

FIG. 2 shows a first embodiment of a substantially gastight layered radio frequency multipole ion guide 30 according to principles of the present disclosure suitable to be used in a mass spectrometer 10 as depicted by way of example in FIGS. 1A and 1B. The substantially gastight design facilitates in particular use at pressure levels which deviate from that of the surrounding environment, for example when it is supplied with an inert gas (or ambient air) to work as a collisional-cooling ion guide or collision cell for collision-induced dissociation.

FIG. 2 illustrates a top view (upper panel) and a front view (lower panel) of a radio frequency ion guide 30 having an ion passage 32 (bold dashed contour) around an axis 34 (thin dashed contour) that follows a 180-degrees bend, such as shown by way of example as collision cell Q2 in FIGS. 1A and 1B. The exemplary ion guide structure consists of seven layers 36*a-g*, a top layer 36*a*, a bottom layer 36*g* and a group of five intermediate layers 36*b-f*. The top and bottom layers 36*a*, 36*g* are integral and may be made from a regularly dimensioned printed circuit board or ceramic plate, for instance, covering the ion guide assembly 30 on two sides. Conventional printed circuit boards consist predominantly of FR-4 glass epoxy plates. Each of the layers 36*b-f* in the group of intermediate layers comprises two plate-like structures, such as further tailor-made printed circuit boards or ceramic plates, which have been cut such that, when being arranged in an opposing relation to one another as shown, a central cut-out is created in the ion guide assembly 30 to render the ion passage 32. For example, the center layer 36*d* and the two layers 36*b*, 36*f* neighboring the top and bottom layers 36*a*, 36*g* comprise a perpendicular edge which makes for a rectangular gap of varying dimensions between the opposing plates. The second and fourth layers 36*c*, 36*e* in the group of intermediate layers, on the other hand, comprise a slanted or beveled edge which makes for a gap between the two layers 36*c*, 36*e* that tapers frusto-conically toward the top and bottom layers 36*a*, 36*g*, respectively. The slanted or beveled edges may be made conductive and electrically contacted such that they can operate as radio frequency electrodes (bold surface contour) in a quadrupole configuration in the example depicted.

If the layers 36*a-g* of the assembly 30 depicted in FIG. 2 are made from printed circuit boards or any other plates of insulating material, electrical contact with the electrodes may be established using conductive tracks deposited on, or integrated into the plates of insulating material. In fact, whole electrical circuits, such as necessary for supplying radio frequencies of opposite phases to pairs of opposing electrodes or for controlling collision-gas/collisional-cooling gas supply or resistor and capacitor networks, can be incorporated into the plate structure. The conductive traces or electric circuits may easily traverse the different layers 36*a-g* from top to bottom (or vice versa) by corresponding provision of embedded conductor tracks.

The four RF electrodes in the quadrupolar arrangement as shown surround an ion passage 32 in which passing ions are confined radially, that is toward a central axis 34 of the assembly 30 which is shown as having a substantially 180-degrees bend from the front to the back of the ion guide 30. In the case of a curved axis the shape of the plates or printed circuit boards constituting the layers of the assembly have to be cut and dimensioned accordingly. It will be acknowledged by practitioners in the field that configurations of such layered structure might also be straight. It also goes without saying that other degrees of curvature, such as forming a 90-degrees bend for use as collisional-cooling ion guide 24 in FIGS. 1A and 1B, for example, or a 60-degrees bend or 120-degrees bend, could be likewise foreseen easily without departing from the general construction principles.

In order to achieve substantial hermetic sealing of the ion passage 32 from the surrounding environment, which may be at atmospheric pressure on the order of $10^5$ pascal, the different layers can be bonded to one another, preferably over the full area of interlayer contact. Bonding can be accomplished by an adhesive, such as epoxy glue, which is spread on the flat faces of the individual plates before the assembly. Alternatively, a two-component adhesive might be used. If gas is to be supplied to the ion passage 32 in order to facilitate the use of the ion guide 30 as collision cell or collisional-cooling ion guide, the layer arrangement may also be equipped with gas channels or conduits (not shown). In other words, channels or conduits can be provided in the insulating material of the different plates through which a working gas, such as an inert or semi-inert gas, may be supplied to the ion passage 32. It is to be noted in this context that a substantially gastight ion guide 30 will basically have just one gas inlet through which gas enters the interior of the ion guide 30, typically located substantially midway along the ion passage 32 of the ion guide 30, and the only gas outlets through which the gas will leave the ion guide 30 will be the front and back ends thereof through which ions pass during operation; in each case following the pressure gradient from higher pressure in the ion guide 30 to lower pressure in the vacuum enclosure to which the ion guide 30 is hermetically attached.

The layered radio frequency multipole ion guide 30 can be provided with a flange structure 38 at the front and back ends by which the ion guide 30 may be mounted to a support structure, such as a side wall 16', 16''' of a vacuum recipient 16 as shown in FIGS. 1A and 1B. Such flanges 38 may be made of a PCB material, machined polyetheretherketone (PEEK) or polycarbonate (PC), for instance. The flange 38 can be further equipped with an elastic, flexible material, such as a rubber O-ring, in order to improve the sealing capacity of the assembly 30 when being mounted to a wall of a vacuum recipient.

Figure 3:
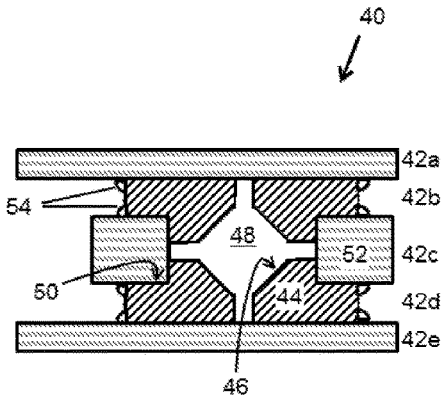
FIG. 3 is a schematic view of a second embodiment of a layered substantially gastight radio frequency (multipole) ion guide.

FIG. 3 illustrates another embodiment of a substantially gastight (and possibly gas-supplied) radio frequency multipole ion guide 40 according to principles of the disclosure. It comprises a top layer 42*a* and a bottom layer 42*e*, both consisting of an integral plate of insulating material such as a ceramic plate or printed circuit board. Four plates of conductive material 44, such as a metal like stainless steel, are sandwiched in two intermediate layers 42*b*, 42*d* between the top and bottom layers 42*a*, 42*e*. The cross section of the conductive plates is basically rectangular but features (i) a central substantially square cut-out brought about by surrounding and opposing beveled edges 46 of the conductive plates at a side facing the ion passage 48 and (ii) a rectangular recess 50 at a side facing away from the ion passage 48 in order to accommodate insulating spacers therein. In order to provide for safe electric decoupling and prevent any electric arcing between the conductive plates 44, two central plates 52 of an insulating material such as ceramic are positioned in a central layer 42*c* between the conductive plates 44 and accommodated in the rear recesses 50 thereof. The two insulating plates 52 thereby take the function of the spacers in the example depicted. The different layers 42*a-e* are bonded to one another rather locally, in order to achieve gastight configuration of the ion passage 48, as is manifest by adhesive drops 54 illustrated at the interfaces between the five different layers 42*a-e* thereby coming to lie at four different levels.

Figure 4:
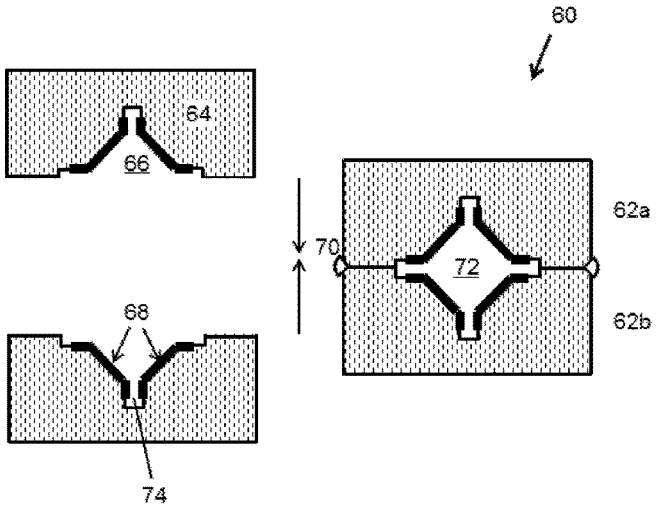
FIG. 4 is a schematic view of a third embodiment of a layered substantially gastight radio frequency (multipole) ion guide.

FIG. 4 is yet another example of a substantially gastight (and possibly gas-supplied) radio frequency multipole ion guide 60 according to principles of the disclosure. In this example, the whole assembly comprises merely two layers 62*a-b* made from two half shells 64 of an insulating material which may be produced by injection-molding from a low-outgassing plastic, for example. The two half shells 64 show the same cross section and will be combined to render the ion guide 60 (right panel). Each half shell 64 comprises a triangular recess 66 with two slanted side walls 68 which are made conductive, such as by metallization, and electrically contacted in order to be operated as radio frequency electrodes (bold surface contour) of the multipole ion guide assembly 60. When brought together, the two half shells 64 may be bonded to one another by local but comprehensive application of adhesive, for instance epoxy glue 70, so that the triangular recesses 66 form a central, substantially square cut-out between their slanted side walls 68 which in turn generate an ion passage 72 around a central axis. Additional inter-electrode cut-outs 74 can be foreseen in order to provide for safe electrical decoupling of the radio frequency electrodes.

Referring now to the particular embodiments of FIGS. 3 and 4, gas flow properties will be exemplified in the following. Given that a normal distance from the axis of the ion passage to the electrode faces ($r_0$) is three millimeters, a normal distance from the axis to the ground of the inter-electrode cut-outs (such as at 74 in FIG. 4) is five millimeters, a curve radius for a bent configuration of the RF ion guide is 60 millimeters, a width of the inter-electrode cut-outs is about two millimeters, the longitudinal (axial) extension of the RF ion guide is about 100 millimeters, a total inner width cross section area of about 45 square millimeters results through which gas may pass. This would correspond to a tube of circular round inner width having a diameter of about 7.5 millimeters. The gas conductance for a straight tube of like inner width dimension and length of about 100 millimeters would be 0.52 liters per second. In order to achieve the same conductance as a 90-degrees RF ion guide having the same dimensions, orifices had to be provided at the front and back ends of the straight tube with a diameter of about 2.4 millimeters, thereby significantly impeding the transmission of ions.

Figure 5A:
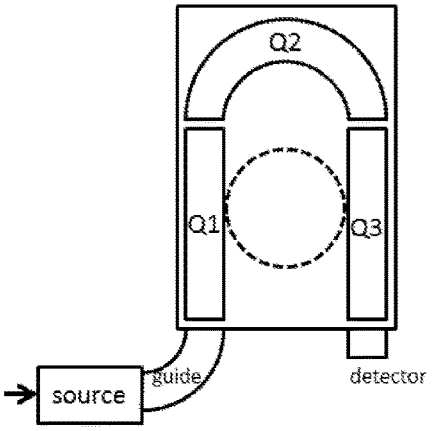
FIG. 5A is a schematic view of another possible design in accordance with principles of the present disclosure.
Figure 5B:
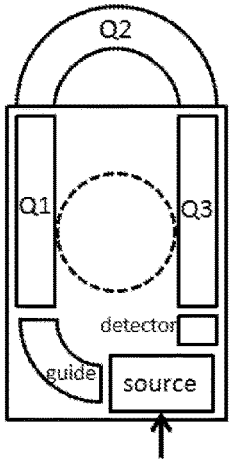
FIG. 5B is a schematic view of yet another possible design in accordance with principles of the present disclosure.

FIGS. 1A and 1B above presented designs where both the 90-degrees collisional-cooling ion guide 24 as well as the 180-degrees collision cell Q2 are positioned outside the gastight volume formed by the walls 16', 16'', etc. of the vacuum recipient 16 while functioning as a sort of spatially-restricted, gastight, pressurized extensions to this gastight volume. FIGS. 5A and 5B now show slight variations of this first mass spectrometer design variant in that the beneficial effects of pumping volume reduction (pumping port indicated as dashed circle at the center) can be achieved when just one of those elements is mounted outside the gastight volume gastight to a wall of the vacuum recipient; in case of FIG. 5A the collisional-cooling ion guide as the substantially gastight link between the ion source and the mass analyzer assembly rests outside the gastight volume whereas the collision cell Q2 is inside; in case of FIG. 5B it is the other way around.

In the description above, emphasis has been placed on exemplifying the principles of the disclosure for quadrupole mass spectrometers, such as triple quadrupole mass spectrometers and, related thereto, single quadrupole mass spectrometers. It goes without saying, however, that the principles of the present disclosure are equally applicable to other mass spectrometers which hyphenate different mass-dispersive analyzers, such as by way of example quadrupole-time of flight mass spectrometers (Q-TOF MS) or quadrupole-Fourier Transform mass spectrometers (Q-FT MS) and the like.

The invention has been illustrated and described with reference to a number of different embodiments thereof. It will be understood by those of skill in the art that various aspects or details of the invention may be changed, or that different aspects disclosed in conjunction with different embodiments of the invention may be readily combined if practicable, without departing from the scope of the invention. Furthermore, the foregoing description is for the purpose of illustration only, and not for the purpose of limiting the invention, which is defined solely by the appended claims and will include any technical equivalents, as the case may be.

The invention claimed is:

1. A mass spectrometer, comprising:

(a) a vacuum recipient containing ion handling elements, the vacuum recipient having a plurality of walls which define a gastight volume and comprise at least one of an entrance and exit, wherein different portions of an ion path pass at least one of the entrance and exit and run through the gastight volume; and (b) a gastight radio frequency ion guide having an ion passage along an axis and being mounted gastight to at least one of the entrance and exit as to extend the gastight volume and continue the ion path in its ion passage outside the vacuum recipient, wherein the gastight radio frequency ion guide is located outside the vacuum recipient in an environment of ambient pressure in order to lower pumping requirements for the mass spectrometer.

2. The mass spectrometer of claim 1, wherein the ion passage has substantially polygonal cross section.

3. The mass spectrometer of claim 1, wherein the ion passage is one of straight and curved.

4. The mass spectrometer of claim 3, wherein an angle of curvature of the ion passage ranges from substantially 45° to 180°.

5. The mass spectrometer of claim 1, wherein at least one of a length and a transverse dimension of the ion passage are chosen such as to facilitate a functioning of the radio frequency ion guide as restrictor tube and to thereby reduce stray gas admission into the gastight volume of the vacuum recipient through the ion passage.

6. The mass spectrometer of claim 1, further comprising a turbo-molecular pump which is docked to the vacuum recipient through a pumping port at one of the plurality of walls.

7. The mass spectrometer of claim 1, wherein the ion handling elements comprise a mass filter being located in the gastight volume, and further comprising an ion source located outside the gastight volume, wherein the radio frequency ion guide is positioned in between the mass filter and the ion source to operate as a collisional-cooling ion guide which transmits a collimated beam of ions from the ion source to the mass filter.

8. The mass spectrometer of claim 1, wherein the gastight radio frequency ion guide has a plurality of layers bonded substantially gastight to one another, at least two layers of the plurality of layers comprising substantially central cut-outs to form the ion passage, wherein at least two layers of the plurality of layers adjacent to the ion passage encompass at least one conductive feature facing the axis and being electrically connected to function as a radio frequency electrode.

9. The mass spectrometer of claim 8, wherein the layers in the plurality of layers are glued substantially gastight to each other.

10. The mass spectrometer of claim 8, wherein the plurality of layers comprises plates of insulating material.

11. The mass spectrometer of claim 10, wherein the plates of insulating material encompass at least one of printed circuit boards and ceramic plates and the electrical connection is brought about by electrical circuits or conductive tracks on or in the printed circuit boards or ceramic plates.

12. The mass spectrometer of claim 8, wherein the plurality of layers comprises two layers of non-conductive material, and wherein the substantially central cut-outs comprise substantially triangular recesses in the two layers opposing one another.

13. The mass spectrometer of claim 12, wherein the at least one conductive feature comprises slanted metallized surfaces at side walls of the substantially triangular recesses.

14. The mass spectrometer of claim 12, further comprising additional cut-outs between the conductive features to provide for safe electrical decoupling of the radio frequency electrodes.

15. The mass spectrometer of claim 8, wherein the plurality of layers comprises a top layer, a bottom layer and a group of intermediate layers.

16. The mass spectrometer of claim 15, wherein the group of intermediate layers comprises plates of conductive material.

17. The mass spectrometer of claim 16, wherein the plates of conductive material are spaced apart from one another by at least one intermediate plate of insulating material.

18. A mass spectrometer, comprising:

(a) a vacuum recipient containing ion handling elements, the vacuum recipient having a plurality of walls which define a gastight volume and comprise at least one of an entrance and exit, wherein different portions of an ion path pass at least one of the entrance and exit and run through the gastight volume; and (b) a gastight radio frequency ion guide having an ion passage along an axis and being mounted gastight to at least one of the entrance and exit as to continue the ion path in its ion passage outside the gastight volume, wherein the ion handling elements comprise two mass filters in a triple quadrupole arrangement being located in the gastight volume, and the radio frequency ion guide is a gas-supplied ion collision cell being positioned along the ion path in between the two mass filters.

19. A mass spectrometer, comprising:

(a) a vacuum recipient containing ion handling elements, the vacuum recipient having a plurality of walls which define a gastight volume and comprise at least one of an entrance and exit, wherein different portions of an ion path pass at least one of the entrance and exit and run through the gastight volume; and (b) a gastight radio frequency ion guide having an ion passage along an axis and being mounted gastight to at least one of the entrance and exit as to continue the ion path in its ion passage outside the gastight volume, wherein the gastight radio frequency ion guide has a plurality of layers bonded substantially gastight to one another, at least two layers of the plurality of layers comprising substantially central cut-outs to form the ion passage, wherein at least two layers of the plurality of layers adjacent to the ion passage encompass at least one conductive feature facing the axis and being electrically connected to function as a radio frequency electrode, the plurality of layers comprising a top layer, a bottom layer and a group of intermediate layers, the group of intermediate layers comprising plates of conductive material, and the at least one conductive feature comprising beveled edges at the plates of conductive material.

20. A mass spectrometer, comprising:

(a) a vacuum recipient containing ion handling elements, the vacuum recipient having a plurality of walls which define a gastight volume and comprise at least one of an entrance and exit, wherein different portions of an ion path pass at least one of the entrance and exit and run through the gastight volume; and (b) a gastight radio frequency ion guide having an ion passage along an axis and being mounted gastight to at least one of the entrance and exit as to continue the ion path in its ion passage outside the gastight volume, wherein the gastight radio frequency ion guide has a plurality of layers bonded substantially gastight to one another, at least two layers of the plurality of layers comprising substantially central cut-outs to form the ion passage, wherein at least two layers of the plurality of layers adjacent to the ion passage encompass at least one conductive feature facing the axis and being electrically connected to function as a radio frequency electrode, the plurality of layers comprising a top layer, a bottom layer and a group of intermediate layers, the group of intermediate layers comprising plates of conductive material, and the plates of conductive material comprising recessed features so as to neatly accommodate parts of the at least one intermediate plate of insulating material.

* * * * *